US005755419A

United States Patent [19]

Gearhart et al.

[11] Patent Number: 5,755,419

[45] Date of Patent: May 26, 1998

[54] BALLOON HOLDER APPARATUS

[75] Inventors: Diane C. Gearhart; Gerald L. Gearhart, both of 10071 Crystal Creek Dr., Sacramento, Calif. 95829

[73] Assignees: Diane C. Gearhart; Gerald L. Gearhart, both of Sacramento, Calif.

[21] Appl. No.: 651,683

[22] Filed: May 21, 1996

[51] Int. Cl.[6] ..... A47B 91/00

[52] U.S. Cl. ..... 248/346.01; 446/220; 248/176.1

[58] Field of Search ..... 248/346.01, 176.1, 248/346.03, 346.04, 346.5, 910, 519, 523, 309.1, 314; 446/220, 222, 223, 226; D21/84

[56] References Cited

U.S. PATENT DOCUMENTS

| | | | |
|---|---|---|---|
| 3,415,475 | 12/1968 | Goodman | 248/910 |
| 4,798,554 | 1/1989 | Nelson et al. | 446/220 X |
| 4,813,902 | 3/1989 | Messer | 446/71 |
| 4,879,823 | 11/1989 | Collins | 40/124.1 |
| 4,881,916 | 11/1989 | Houser | 446/222 |
| 4,936,532 | 6/1990 | Williams | 248/205.3 |
| 4,953,713 | 9/1990 | Yahe | 446/223 X |
| 5,011,447 | 4/1991 | Watanabe | 446/220 |
| 5,016,848 | 5/1991 | Metz | 248/176 |
| 5,024,011 | 6/1991 | Collins | 40/124.1 |
| 5,035,391 | 7/1991 | Steele et al. | 248/346 |
| 5,074,510 | 12/1991 | Metz | 248/176 |
| 5,188,314 | 2/1993 | Peters | 244/31 |
| 5,203,530 | 4/1993 | Liu | 248/309.1 |
| 5,395,276 | 3/1995 | Valentino | 446/217 |
| 5,509,540 | 4/1996 | Pomerantz | 211/13 |

*Primary Examiner*—Ramon O. Ramirez
*Assistant Examiner*—Anita M. King
*Attorney, Agent, or Firm*—John P. O'Banion

[57] ABSTRACT

A balloon holder apparatus having a hollow body and weighted base. A slot in the body extends from a bottom edge to an opening in the center or top of the body. A slot in the base extends from an outer edge of the base to a central opening in the base. When the base and body are joined together, the slot in the body connects to and is generally aligned with the slot in the base. A knotted balloon tether is slipped through the aligned slots until the tether enters the opening in the body and the knot in the tether is adjacent the central opening in the base. The tether is then released and the knot is drawn into the hollow interior of the body and retained therein thereby holding the tethered balloon to the apparatus. A plurality of tethered balloons may be held by the apparatus in a like manner.

22 Claims, 5 Drawing Sheets

BALLOON HOLDER APPARATUS

BACKGROUND OF THE INVENTION

1. Field of the Invention

This invention pertains generally to devices and methods for holding or tethering balloons and other lighter-than-air items, and more particularly to a balloon holder apparatus wherein a plurality of helium balloons having tethers of varying lengths can be quickly and easily attached and removed.

2. Description of the Background Art

Helium-filled balloons are frequently utilized as decorations at birthday parties and other festive events. Numerous devices and methods have been developed for holding or retaining such balloons on tables and other surfaces. Typically, a helium-filled balloon is tied shut at the balloon opening with a string, with the string being used to tie or tether the balloon to an object. Since many objects such as tables to which balloons are to be affixed do not provide suitable features for attachment of balloon strings, weighted bases or platforms having an attached loop or ring have been utilized for holding balloons, with the balloon strings tethered to the loop or ring. Also known is a balloon hanger comprising a plate with closure tabs which act as closures for receiving and holding the balloon opening in a manner such that pressurized gas within the balloon does not escape from the balloon.

Prior devices and methods for holding balloons, however, have proved deficient in various respects. Particularly, it is difficult and time consuming to individually tie each of a plurality of balloon strings to a ring, loop or other object. Further, the use of closure tab devices allow attachment of only a small number of balloons to the device due to the relatively large space occupied by the filled balloons. Additionally, the knots used to tie balloon strings to objects tend to be aesthetically unpleasant and detract from the overall appearance of tethered balloons. Similarly, the use of adhesive tape to hold balloon strings to a surface creates an unattractive appearance. Yet another drawback present in background art balloon holding devices is the failure to provide adequate smooth surfaces on the devices to allow stenciling or printing thereon of names, greeting messages, designs, and other decorative features.

Accordingly, there is a need for a balloon holder apparatus which can be used for holding balloons onto various surfaces or objects, which provides for quick and easy attachment and detachment of a plurality of balloon strings or tethers, which is aesthetically pleasant, and which provides clean, smooth surfaces for messages and decorations. The present invention satisfies these needs, as well as others, and generally overcomes the deficiencies found in the background art.

SUMMARY OF THE INVENTION

The present invention pertains to a balloon holder apparatus, for use on horizontal and vertical surfaces, which allows quick and easy attachment of several balloons to the apparatus by strings or tethers. In its most general terms, the invention includes a body portion with at least one opening, a base which detachably couples to the body, at least one slot in the body which communicates with the opening therein, and at least one slot in the base which connects with and is substantially aligned or co-planar with the slot in the body when the base and body are joined together.

By way of example and not of limitation, the body of the apparatus is preferably hollow and hemispherical in structure and configuration, with the opening located generally adjacent the apex, center or top of the hemisphere. The body generally has a smooth external surface suitable for placing names, messages, greetings, and decorations thereon. The slot in the body is preferably vertically oriented and extends from the top opening to a bottom edge of the body. A receptacle preferably extends downward into the body from the top opening, with an aperture at the bottom of the receptacle communicating with the hollow interior of the body. The base is preferably of flat, disk-like circular structure and configuration, and snap fits onto the body along its bottom edge in either a fixed or detachable manner. The base is made of a heavy material such as metal or the like, or is alternatively made from plastic, rubber or the like to which a weight is attached, to counteract the buoyancy of tethered balloons. Additional weights or ballast may be included within the hollow body above the base. An opening is preferably included in the base and is positioned generally in the center of the base and below the top opening in the body when the base is attached to the body. The slot in the base extends from an outer edge of the base to the central opening. A notch may be included in the base in connection with the central opening to allow the base to be attached to a vertical surface via bolts, screws or nails. The base and body detachably couple together by snap fitting means, and a flat portion is provided on the bottom edge of the body and outer edge of the base to allow for easy and convention alignment of the slots in the base and body, as well as to prevent rotation of the body in relation to the base.

The balloon holder apparatus comprising the invention is utilized with a plurality of helium balloons having pendant strings. The base and body portions of the apparatus are snap-fitted together with the slot on the body generally aligned with the slot in the base. A simple knot is made in the free end of each balloon string or tether, and each string is then inserted or slipped through the slots in the base and body while the knot is held below the base, until the string reaches the top opening in the body and central opening in the base. The balloon and string are then released, and the knot in the string is drawn upward through the top opening in the body until the knot reaches the opening. The top opening has a diameter sufficiently wide to allow passage of the balloon string while retaining the knot on the string within the interior of the body. A plurality of balloons with knotted strings or tethers of varying length may be held by the balloon holder apparatus in the above-described manner, to provide different arrangements of tethered balloons. A plurality of tethered balloons may be prepared and knotted together in a desired arrangement with strings or tethers of varying lengths, and then the collected strings of the balloon arrangement may be simultaneously slipped through the slots in the same manner as a single string, with the collected knotted ends held within the interior of the body. The weighted base of the balloon holder apparatus prevents the buoyancy of the balloons from lifting the apparatus. The balloon tethers or strings can be removed by reversing the steps described above or, alternatively, by detaching the base from the body and slipping the knotted ends of the strings along the slot in the body until the knot clears the edge of the body. The receptacle adjacent the top opening may be used to hold a pen, pencil, flag pole, banner or the like. Additionally, the apparatus can be used as a paperweight.

An object of the invention is to provide a balloon holder apparatus which allows quick and easy attachment of a plurality of tethered balloons.

Another object of the invention is to provide a balloon holder apparatus which can be used on horizontal surfaces such as table tops or mounted on vertical surfaces such as walls.

Another object of the invention is to provide a balloon holder apparatus which has a hollow body wherein additional ballast can be placed to accommodate additional balloons.

Another object of the invention is to provide a balloon holder apparatus which is aesthetically pleasant.

Another object of the invention is to provide a balloon holder apparatus which has surfaces suitable for placement of names, greeting messages and decorations thereon.

Another object of the invention is to provide a balloon holder apparatus which can hold a pen, pencil, flag pole, banner or the like, and which can be used as a paperweight.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
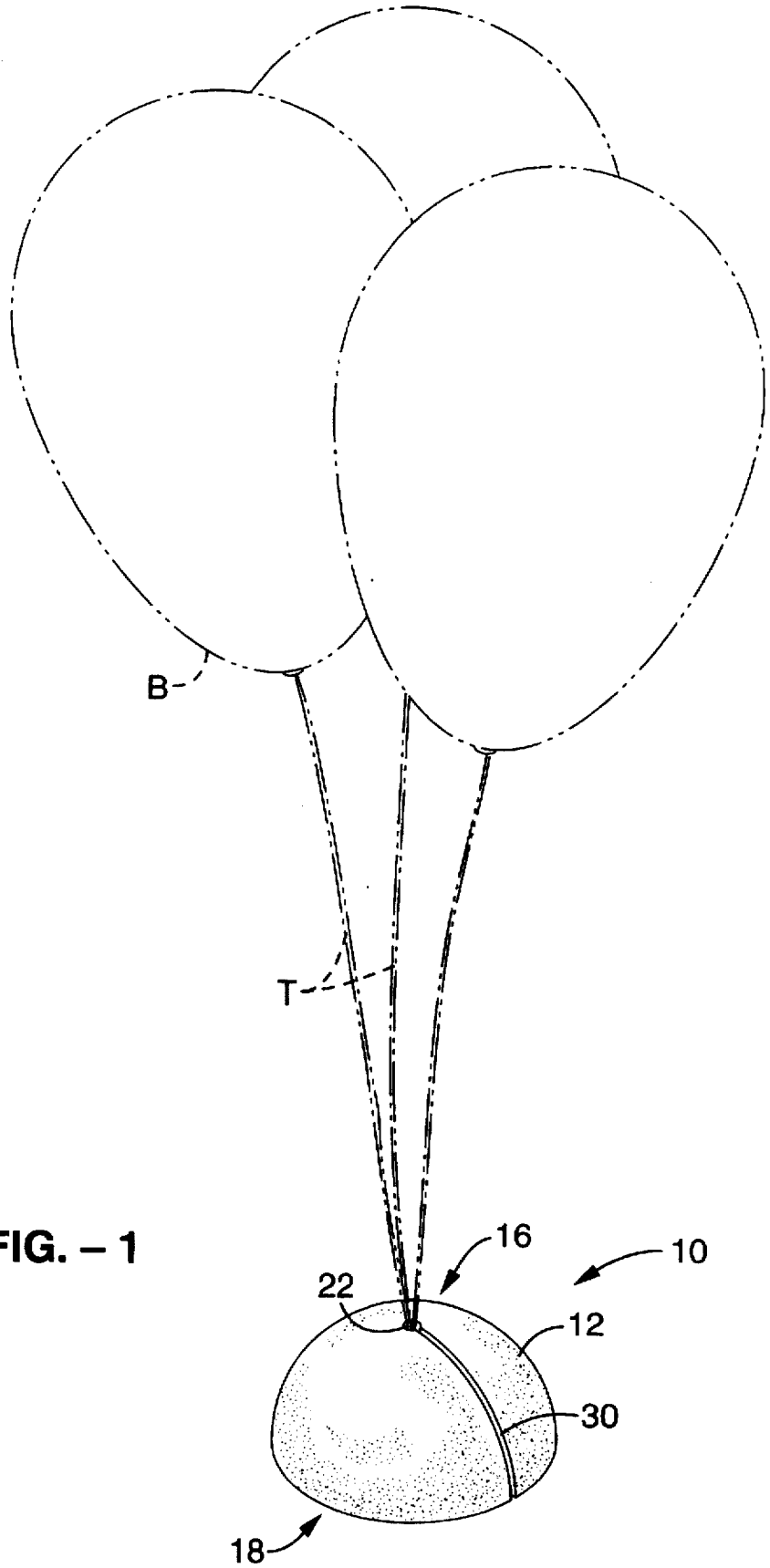
FIG. 1 is a perspective view of a balloon holder apparatus in accordance with the present invention, together with a plurality of tethered balloons shown in phantom.
Figure 2:
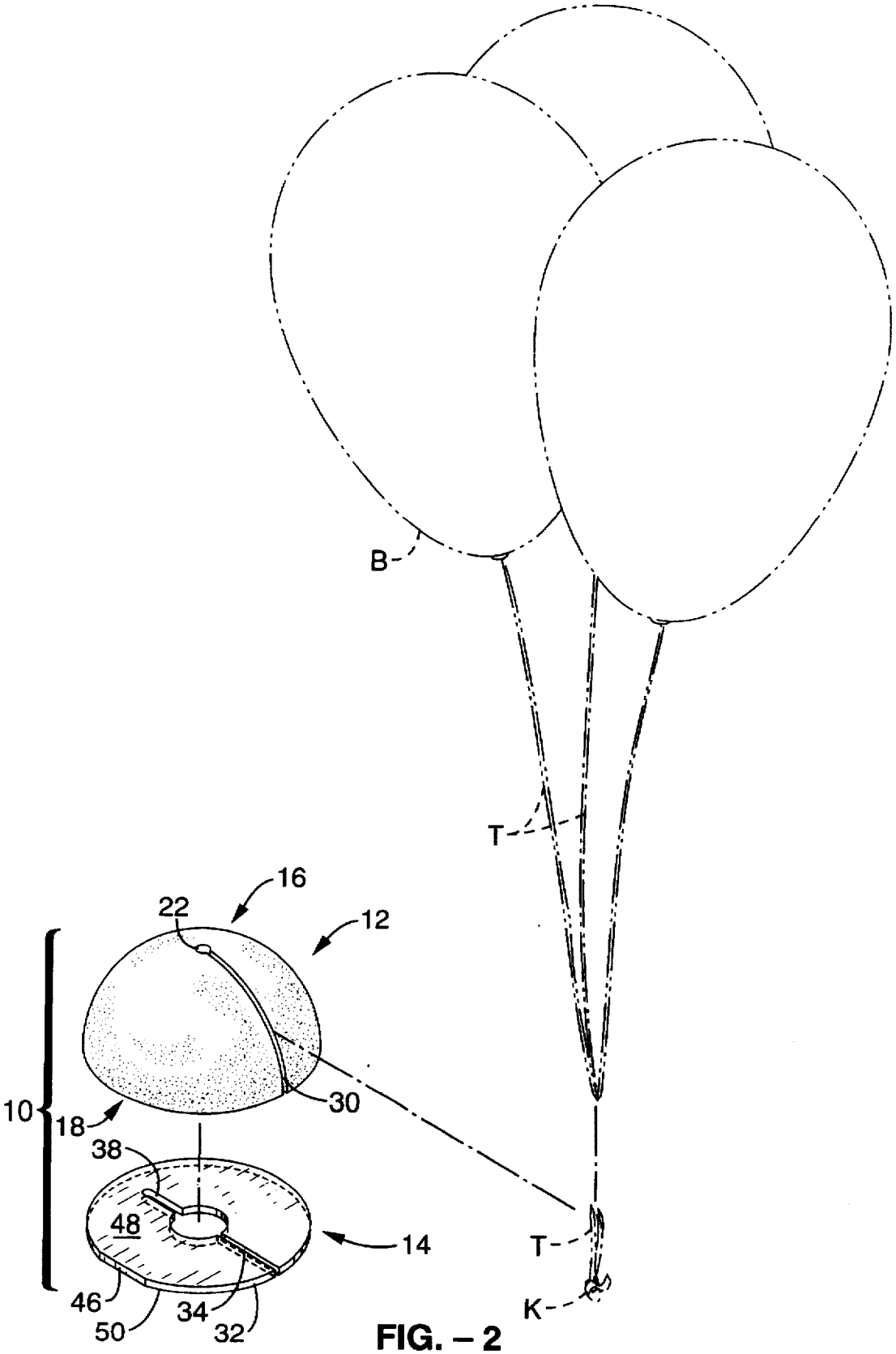
FIG. 2 is an exploded view of the balloon holder apparatus and tethered balloons shown in FIG. 1.

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Referring first to FIG. 1 through FIG. 5, there is shown a balloon holder apparatus 10 in accordance with the invention. Balloon holder apparatus 10 generally comprises a body portion 12 and a base portion 14 which is either fixedly or detachably coupled to body 12. Body 12 is shown as generally hemispherical in shape, and includes a top or apex 16 and a generally circular bottom edge 18. It is also contemplated that body 12 may be of pyramidal, conical, trapezoidal, square, oblate, or other shape rather than hemispherical in shape as shown. The external surface of body 12 is preferably smooth and unobstructed so that the external surface of body 12 may include printed or stenciled names, greeting messages, or decorative features or designs (not shown) on the external surface. Body 12 is preferably constructed of polystyrene, which is particularly suitable for graphics and decorative features, although various plastic, metallic and other materials may be used for construction of body 12. Preferably, body 12 includes a hollow interior 20 (FIG. 4) to accommodate weights or ballast (not shown), although body 12 may alternatively be of solid construction.

Figure 4:
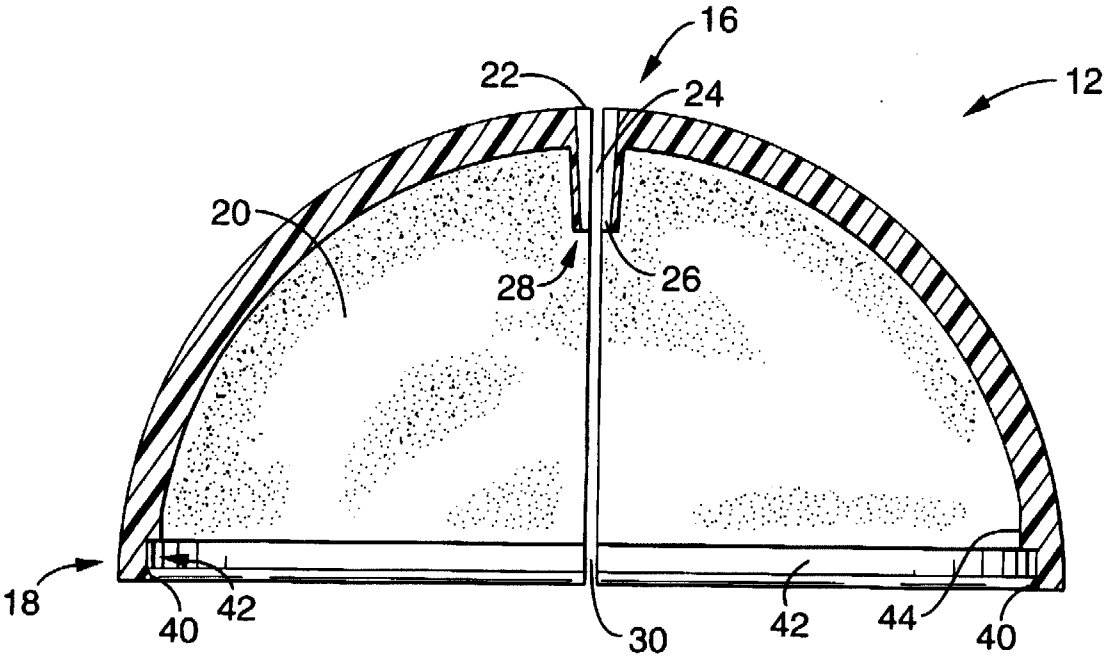
FIG. 4 is a cross-sectional view of the body portion of the balloon holder apparatus of FIG. 3 taken through line 4—4.

An opening 22 is included in body 12, with opening 22 preferably located centrally and adjacent the top 16 of body 12. Referring more particularly to FIG. 4, a receptacle 24 extends into body 12 from opening 22, and an aperture 26 is included at a lower end 28 of receptacle 24, with aperture 26 communicating with the hollow interior 20 of body 12. Aperture 26 has a radius or diameter which is generally smaller than that of receptacle 24 and opening 22. Receptacle 24 preferably has a tapered, tubular structure and configuration and can hold or accommodate a pen or pencil, as discussed further below. A slot 30 is included in body 12, with slot 30 communicating with the hollow interior 20 of body, and extending between bottom edge 18 and top opening 22 and receptacle 24 in body 12 in a generally vertical orientation as shown. Slot 30 is sufficiently wide to allow passage of standard gauge balloon strings or tethers T through slot 30, but is not wide enough to allow knotted ends K on tethers T to pass through. Aperture 27 preferably has a radius or diameter sufficient to accommodate a plurality standard gauge balloon tethers T, but which is too narrow or restricted to allow passage of knotted ends K of tethers T through aperture 26, as discussed below.

Figure 3:
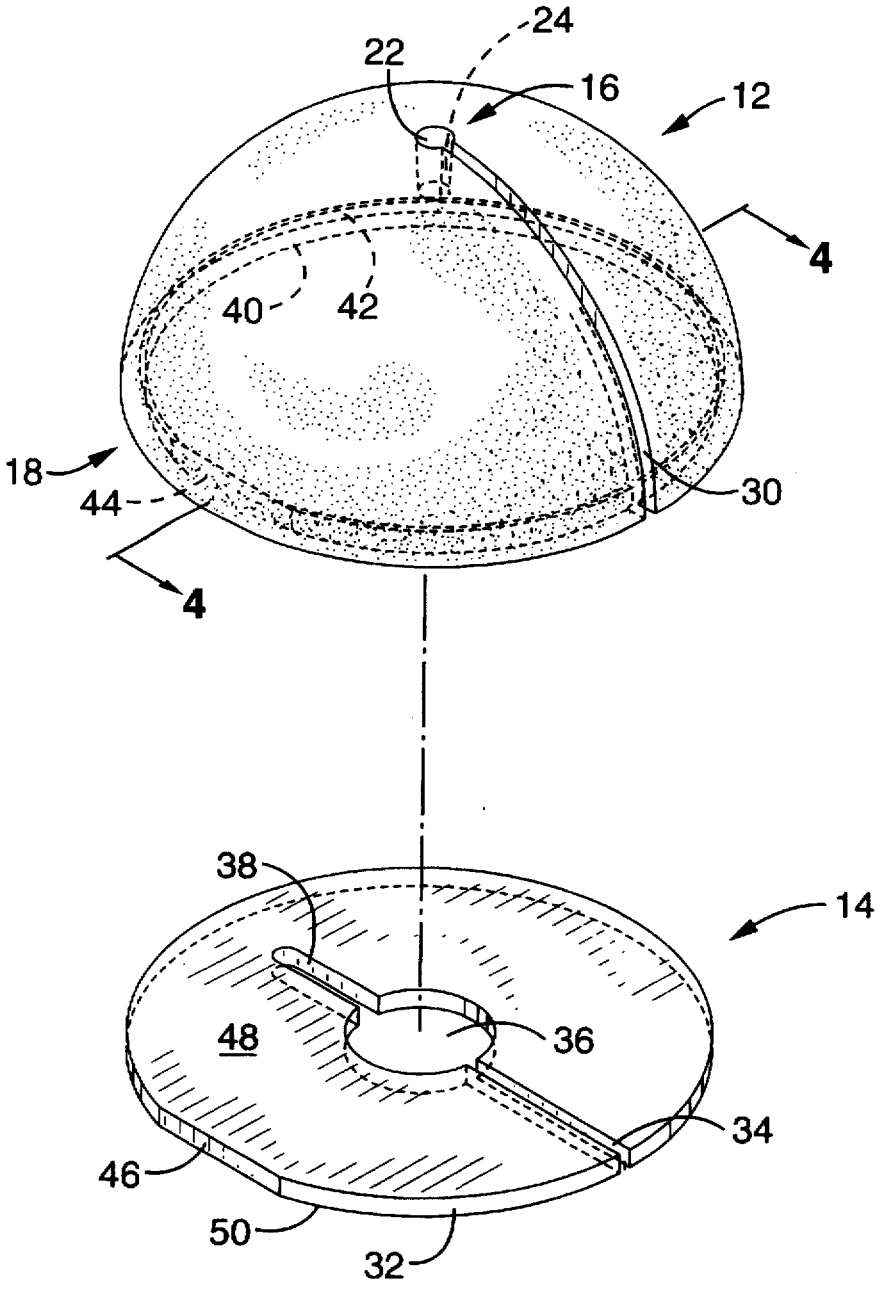
FIG. 3 is an exploded view in detail of the balloon holder apparatus comprising the present invention.

As can be seen from FIG. 3, base 14 is preferably of flat, disk-shaped construction and includes an outer edge 32. A slot 34 is provided in base 14, with slot 34 extending inward from outer edge 32 towards the center of base 14. A centrally located opening 36 is preferably included in base 14, with slot 34 extending between outer edge 32 and central opening 36 of base 14. A notch 38 extends outward from central opening 36 in base 14, preferably opposite slot 34. Notch 38 allows base 14 to be attached to a screw, nail, hook, bolt or like object projecting from a vertical surface, as described further below. Base 14 is made of a heavy material such as metal or the like, or is alternatively made from plastic, rubber or the like to which a weight is attached, to counteract the buoyancy of tethered balloons. If a separate weight is used, it can be attached to base 14 using conventional means such as glue, or one or more weight receiving receptacles can be added to base 14. Additional weights or ballast may be included within the hollow of body 12 above base 14.

While base 14 is shown as generally disk-shaped to accommodate hemispherical shaped body 12, the general shape of base 14 may be varied as required for a differently shaped body 12. Slot 34, like slot 30, is sufficiently wide to allow passage of standard gauge balloon strings or tethers T through slot 34, but is not wide enough to allow a knotted ends K on tethers T to pass through slot 34.

Figure 5:
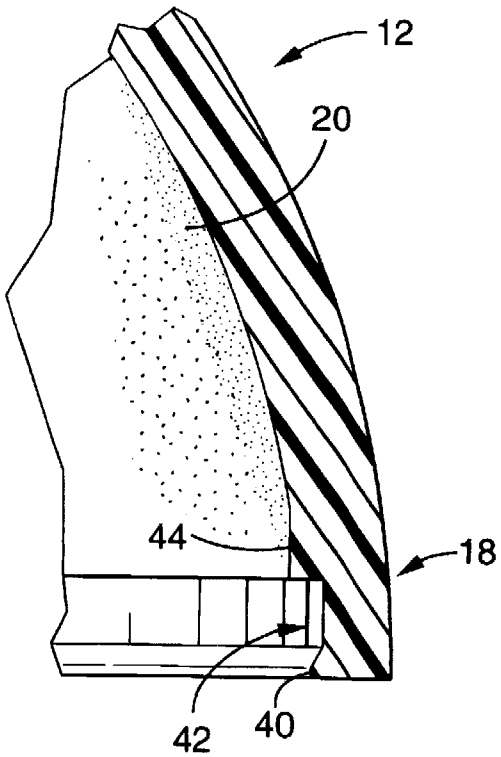
FIG. 5 is a detail of a portion of the cross-sectional view of FIG. 4.

Base 14 is detachably coupled or fixedly joined to body 12, preferably along bottom edge 18 of body 12, by snap fitting means. Referring more particularly to FIG. 4 and FIG. 5, an inward facing annular lip or flange 40 is provided along bottom edge 18 of body 12, with lip 40 preferably having a tapered shape as shown in FIG. 5. An annular groove or channel 42 is included adjacent annular lip 40. As can be seen from FIG. 3, in the embodiment shown outer edge 32 of base 14 is structured and configured to reversibly snap fit over lip 40 into groove 42 in order to detachably couple base 14 to body 12. Annular lip 40 is preferably integral to bottom edge 18 and body 12, and made of the same durable, resilient material as body 12 to allow repeated snap fitting and removal of outer edge 32 of base 14 without fatigue or damage to lip 40 and body 12 generally. The tapered shape of annular lip 40 further aids in snap fitting of base 14 onto body 12 without cracking or damage to the polymeric material comprising body 12.

When base 14 and body 12 are joined together, slot 30 in body 12 is in substantial alignment with slot 34 in base 14, with slot 30 generally communicating or connecting with slot 34 at the point where outer edge 32 of base 14 meets the bottom edge 18 of body. Preferably, alignment means are provided with the invention in the form of flat portion or region 44 on bottom edge 18 of body 12 and a corresponding flat portion or region 46 (FIG. 3) on outer edge 32 of base 14.

Flat portions 44, 46 are positioned on bottom edge 18 of body 12 and outer edge 32 of base, respectively, so that, in order for base 14 to snap fit onto body 12, flat portions 44, 46 are adjacent to each other and slots 30, 34 are aligned to meet at outer edge 32 of base 14 and bottom edge 18 of body 12. Additionally, if desired flat portions 44, 46 can be configured to provide means for detaching base 14 from body 12 by insertion of the head of a screw driver or like tool between a central part of flat portions 44, 46 to aid in the disengagement of outer edge 32 of base 14 from annular groove 42 and lip 40 on bottom edge 18 of body 12. Alternatively, flat portions 44, 46 may be omitted, and outer edge 32 of base 14 can be structured and configured to slidably rotate within annular groove 42 when base 14 and body 12 are coupled together. In this case, base 14 may be rotatably positioned relative to body 12 in order to align slots 30, 34.

Referring to FIG. 1 through FIG. 4, the invention is generally utilized by snap fitting outer edge 32 of base 14 over annular lip 40 into annular groove 42, with flat portion 44 on bottom edge 18 of body 12 adjacent flat portion 46 on outer edge 32 of base 14, and with slot 30 in body generally connected to and in substantial alignment with slot 34 in base 14. The apparatus 10 is thus ready for use with helium balloons B having dependent strings or tethers T, with tethers T having knots K at the lower ends thereof. A balloon tether T is slipped through aligned slots 30, 34 while the knot K at the lower end of the tether T is held below central opening 36 in base 14. Slot 30 communicates with receptacle 24, and tether T is slipped into receptacle 24 in body 12. The balloon tether T is then released, and the buoyancy of balloon B draws the knot K at the end of tether T upward through central opening 36 in base 14 and into the hollow interior 20 of body 12. As mentioned above, aperture 26 at the lower end 28 of receptacle 24 is structured and configured to allow passage of tethers T while retaining the knots K at the ends of tethers T within hollow interior 20 of body 12, thereby holding tethered balloons B to the apparatus 10. Receptacle 24 and top opening 22 are preferably structured and configured to accommodate multiple balloon tethers T, and thus a plurality of knotted balloon tethers T with attached balloons B may similarly be held by the invention by repeating the above procedure. Alternatively, a plurality of balloon tethers may first be knotted together to form an arrangement of balloons with tethers of the same or varying lengths, and the combined tethers may be passed through slots 30, 34 together, with the combined knots retained within body interior 20 by the restriction point at aperture 26 in the manner described above. The knotted portions K of tethers T, which tend to be unattractive, are located within the interior 20 of body 12 and hidden from view, and thus the balloon holder apparatus 10 provides an aesthetic manner for holding a plurality of balloons.

Weighted base 14 serves as ballast and counteracts the buoyancy of balloons B to retain the balloon holder apparatus 10 with attached balloons B on table tops or other surfaces. Additional weights or ballast may be attached on the upper surface 48 of base 14 or included elsewhere within hollow interior 20 of body. While coupled to body 12, base 14 is slightly recessed relative to bottom edge 18 of body 12 to allow attachment of adhesive strips or pads (not shown) to the lower surface 50 of base 14 to further aid in holding the balloon holder apparatus 10 onto surfaces.

The balloon holder apparatus 10 may be affixed to vertical surfaces by use of notch 38 and central opening 36 in base 14, together with a nail, screw, bolt or like item (not shown) which is mounted in a vertical surface such as a wall. Central opening 36 is placed over the screw head, and the screw is slid into notch 38, thereby holding base 14 (and the apparatus 10) onto the screw.

Figure 6:
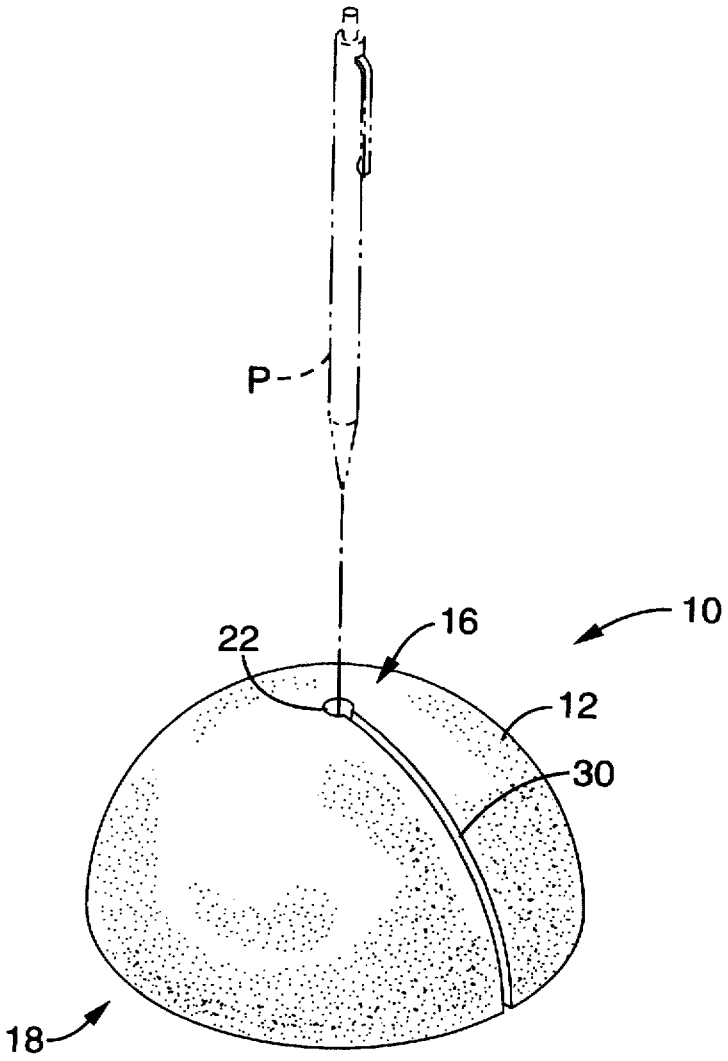
FIG. 6 is a perspective view of the balloon holder apparatus showing its use as a pen or pencil holder.

Referring now to FIG. 4 and FIG. 6, the balloon holder apparatus 10 can be used for holding a pen or pencil P when not used for holding balloons. Receptacle 24 is preferably tapered in shape, and is structured and configured to receive and hold a pen or pencil P. Alternatively, receptacle 24 can be used to hold a flag pole, banner or the like. Further, additional receptacles may be included in body 12 so that both balloons and a pen, pencil, flag pole, banner or the like may be held at the same time by the apparatus 10. Also, it is contemplated that slot 30 in body 12 may be used to hold a greeting card (not shown). In addition, the apparatus can be used as a paperweight.

The balloon holder apparatus 10 may be modified such that receptacle 24 in body 12 of the apparatus 10 may be omitted, if desired, and top opening 22 structured and configured to allow passage of balloon tethers T while retaining the knotted ends K of the tethers T within the hollow interior 20 of body 12.

The balloon holder apparatus 10 may also be modified to accommodate a larger number of tethered balloons by providing a plurality of openings 22 and receptacles 24 in body 12, with a plurality of slots 34 each extending from the bottom edge 18 of body 12 to a corresponding receptacle and opening. Each slot and connected receptacle and opening would be used to hold one or more knotted balloon tethers T with attached balloons B in the manner described above.

Accordingly, it will be seen that this invention provides a balloon holder apparatus which allows quick and easy attachment of several balloons to the apparatus by strings or tethers, which may be mounted on vertical as well as horizontal surfaces, and which is aesthetically pleasant. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A balloon holder apparatus, comprising:

(a) a body, said body including at least one opening, said body including at least one slot, said slot communicating with said opening; and (b) a base, said base having an opening, said base having an outer edge, said base including at least one slot, said slot in said base substantially aligned with and connected to said slot in said body when said base and said body are coupled together, said slot extending from said outer edge to said opening;

(c) wherein said body and said base form an enclosed chamber when coupled together.

2. A balloon holder apparatus as recited in claim 1, further comprising a receptacle extending into said body from said opening in said body, said slot in said body communicating with said receptacle.

3. A balloon holder apparatus as recited in claim 1, wherein said body is of hemispherical structure and configuration, and said opening in said body is located adjacent the top of said body.

4. A balloon holder apparatus as recited in claim 1, wherein said body includes a bottom edge, said base coupled to said body adjacent said bottom edge, said slot in said body extending between said opening and said bottom edge.

5. A balloon holder apparatus as recited in claim 2, wherein said body has a hollow interior and said receptacle includes an aperture at a lower end, said aperture communicating with said hollow interior.

6. A balloon holder apparatus, comprising:

(a) a body, said body including a bottom edge, said body including at least one opening, said body including at least one slot, said slot extending between said bottom edge and said opening;

(b) a base, said base coupled to said body adjacent said bottom edge, said base including a central opening, said base including an outer edge, said base including at least one slot extending between said central opening and said outer edge; and (c) means for aligning and connecting said slot in said base with said slot in said body when said base and said body are coupled together.

7. A balloon holder apparatus as recited in claim 6, further comprising a receptacle extending into said body from said opening in said body, said slot in said body communicating with said receptacle.

8. A balloon holder apparatus as recited in claim 6, wherein said body is of hemispherical structure and configuration, and said opening is located adjacent the top of said body.

9. A balloon holder apparatus as recited in claim 7, wherein said body has a hollow interior and said receptacle includes an aperture at a lower end, said aperture communicating with said hollow interior.

10. A balloon holder apparatus as recited in claim 6, wherein said bottom edge of said body includes an inward facing lip, said outer edge of said base snap fitting over said lip.

11. A balloon holder apparatus as recited in claim 10, wherein said base further comprises a notch adjacent said opening in said base, said notch positioned opposite said slot in said base.

12. A balloon holder apparatus, comprising:

(a) a body, said body having a hollow interior, said body including a top portion, said body including a bottom edge, said body including at least one opening adjacent said top portion, said body including at least one slot, said slot extending between said bottom edge and said opening;

(b) a base, said base including an outer edge, said base including a central opening, said base including at least one slot, said slot extending between said outer edge and said central opening;

(c) means for coupling said base to said body, said coupling means associated with said bottom edge of said body and said outer edge of said base; and (d) means for aligning and connecting said slot in said base with said slot in said body when said base and said body are coupled together.

13. A balloon holder apparatus as recited in claim 12 further comprising a receptacle extending into said body from said opening in said body, said slot in said body communicating with said receptacle, said receptacle including an aperture at a lower end, said aperture communicating with said hollow interior.

14. A balloon holder apparatus as recited in claim 13, wherein said body is of hemispherical structure and configuration.

15. A balloon holder apparatus as recited in claim 12, wherein said coupling means comprises an inward facing lip on said bottom edge of said body, said outer edge of said base snap fitting over said lip.

16. A balloon holder apparatus as recited in claim 12, wherein said base further comprises a notch adjacent said central opening in said base, said notch positioned opposite said slot in said base.

17. A balloon holder apparatus as recited in claim 12, wherein said aligning and connecting means comprises a flat portion on said bottom edge of said body and a flat portion on said outer edge of said base, said flat portions positioned so that said slot in said base is connected to and substantially aligned with said slot in said body when said flat portion on said outer edge of said base is adjacent said flat portion on said bottom edge of said body.

18. A balloon holder apparatus, comprising:

(a) a body, said body including a bottom edge, said body including at least one opening, said body including at least one slot, said slot extending between said bottom edge and said opening; and (b) a base, said base coupled to said body adjacent said bottom edge, said base including a central opening, said base including an outer edge, said base including at least one slot extending between said central opening and said outer edge, said slot in said base substantially aligned with and connected to said slot in said body when said base and said body are coupled together;

(c) said bottom edge of said body including an inward facing lip, said outer edge of said base snap fitting over said lip.

19. A balloon holder apparatus as recited in claim 18, further comprising a receptacle extending into said body from said opening in said body, said slot in said body communicating with said receptacle.

20. A balloon holder apparatus as recited in claim 18, wherein said body is of hemispherical structure and configuration, and said opening is located adjacent the top of said body.

21. A balloon holder apparatus as recited in claim 19, wherein said body has a hollow interior and said receptacle includes an aperture at a lower end, said aperture communicating with said hollow interior.

22. A balloon holder apparatus as recited in claim 18, wherein said base further comprises a notch adjacent said opening in said base, said notch positioned opposite said slot in said base.

* * * * *